US005333523A

United States Patent [19]

Palm

[11] Patent Number: 5,333,523

[45] Date of Patent: Aug. 2, 1994

[54] SNAP-ON QUICK RELEASE EXTENSION AND DRIVERS

[76] Inventor: Bernhard Palm, 17420 Continental Dr., Brookfield, Wis. 53005

[21] Appl. No.: 806,834

[22] Filed: Dec. 10, 1991

Related U.S. Application Data

[63] Continuation-in-part of Ser. No. 642,462, Jan. 17, 1991, abandoned.

[51] Int. Cl.[5] ..... B25B 23/16; B25G 1/04

[52] U.S. Cl. ..... 81/177.85; 81/177.2; 403/325

[58] Field of Search ..... 81/177.85, 177.2; 403/325, 328, 356–358, 361, 329

[56] References Cited

U.S. PATENT DOCUMENTS

| | | | |
|---|---|---|---|
| 4,537,100 | 8/1985 | Palm | 81/177.85 |
| 4,589,308 | 5/1986 | Palm | 81/177.85 |
| 4,770,073 | 9/1988 | Palm | 81/177.85 |
| 4,938,107 | 7/1990 | Nickipuck | 81/177.85 |

*Primary Examiner*—D. S. Meislin

*Attorney, Agent, or Firm*—Bayard H. Michael

[57] ABSTRACT

Each end of the cross bore in the end of the driver or extension is coined to capture the balls in the cross bore. The combined diameters of the balls are equal to the distance between the opposed flat faces of the driver end. One of the faces has a groove in which the lock tab or key is received. The key is part of the control means which includes annular spring seat captured inside the sleeve mounted on the driver. The compressed spring inside the sleeve biases the seat and key to the left so the key overlies the balls. The spring force acts to rock the tab against the ball to project the other ball from the driver end into locking engagement with a recess in the socket. When the projecting ball is pushed into the cross bore as the socket is being mounted the other ball is pushed out of the bore to raise the tab to be engaged by the socket. This causes the tab and seat to be moved to compress the spring. The tab and the seat can move with and with respect to the sleeve. The sleeve is preferably cylindrical with a washer fixed on the shoulder at the rear end of the sleeve by crimping the sleeve. The tapered sleeve construction is more difficult to produce.

9 Claims, 2 Drawing Sheets

SNAP-ON QUICK RELEASE EXTENSION AND DRIVERS

This is a continuation-in-part of application Ser. No. 07/642,462 now abandoned.

BACKGROUND OF THE INVENTION

My prior U.S. Pat. Nos. 4,589,308; 4,537,100; and 4,770,073 show devices of the type disclosed herein. These devices employed some parts which required machining which raised the cost of manufacture. The user could cause malfunction of the tool while attempting to connect the extension to a socket if his grip would interfere with the movement of the sleeve. The present invention is directed towards reduction of cost of manufacture. The product has been improved to be easier to use and to be manufactured at a lower cost.

While the sleeve can be made various ways, it is a further object of this invention to provide a novel sleeve construction which is not obvious but which results in production economies, superior performance and reliability.

SUMMARY OF THE INVENTION

My prior patents employed an angled cross bore (or equivalent) in which the lock member (a pair of balls or equivalent) was mounted. The angled bore was used so the ball which did not engage the slider or key would engage the socket first and ensure a given sequence in actuating the slider. This then lifted the end of the slider to butt against the socket and pushed the slider and the associated sleeve away from the end of the extension. If the user was holding the extension in such a way as to interfere with movement of the slider the connecting process was difficult or impossible.

This invention provides for movement of the key or slider (or key) independently of the sleeve so if the user is preventing movement of the sleeve the function of the slider is not affected and the connection with the socket can be completed. This construction is also simpler and effects a cost saving. My prior designs fixed the lock tab or key relative to the sleeve. I find it is better to provide for relative motion.

The sleeve in my prior patents was a machined part. My new design can be made with deep drawn parts or with tubing crimped to engage the extension and to provide a seat for the key assembly and the associated spring. This results in substantial savings.

This invention also provides for use of the concept in a compact driver incorporating a universal joint. This construction is novel and results in a very compact structure.

U.S. Pat. No. 4,938,107, dated Jul. 3, 1990, shows a drive extension which is very broadly similar to the present device but it requires expensive machined parts.

DETAILED DESCRIPTION OF THE DRAWINGS

Figure 1:
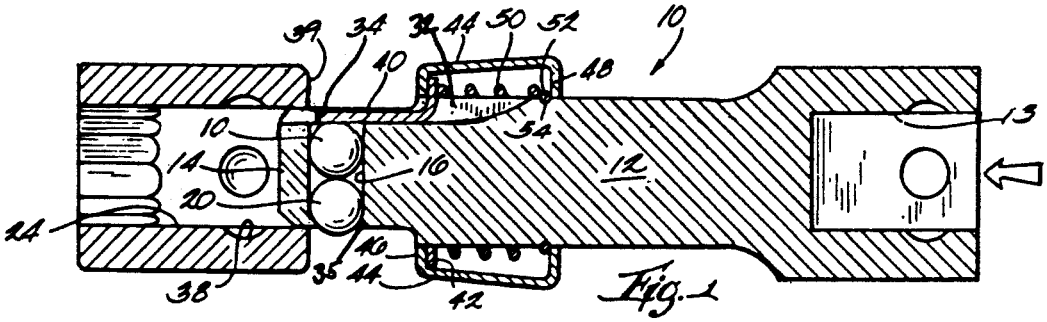
FIG. 1 is a vertical section through my new driver as it enters a socket.

The extension can be a driver on a wrench and have no extension function. Therefore, the extension can be called a driver and the terms are used interchangeably. The driver 10 has a solid round cylindrical shaft 12 of the desired length. One end of the driver is provided with a recessed square hole 13 which may be connected to and driven by the customary wrench. The other end of the driver has a square end 14 dimensioned to fit one of the standard socket wrench sizes. Drive end 14 has a cross bore 16 in which two balls 18, 20 are retained by conventional coining operations at each end of the cross bore to reduce the opening to less than the ball diameter. The axis of the cross bore is perpendicular to the axis of the driver and this is contrary to the teaching of my prior patents. I previously felt it quite important to angle the cross bore so the ball closer to the end of the driver would always engage the socket first to ensure the proper sequence of operating the control tab to allow the ball 20 to be depressed to lift the control tab 36 via ball 18 before the driver is fully inserted into the socket. I now find the bore can be perpendicular and work satisfactorily although sometimes requiring a little wiggling to free the tip of the control tab 40. A perpendicular cross bore is much less costly to make as compared to the angled bore. The angled cross bore is superior but costs more.

As viewed in the drawings, an axial groove 32 in the middle of the flat drive face 34 and has a depth which, when added to the length of the cross bore measured from the bottom of the groove, is equal to the combined diameters of the two balls 18 and 20. This permits the balls to lie wholly between the two opposed flat faces when the control tab or key 40 is moved to position the lock portion 36 in an unobstructing position. When the tab is in the obstructing position shown in FIGS. 1 & 2 ball 20 projects to a lock position beyond the flat face 35 of the driver. When the drive end is inserted into the recess 24 of a socket the projecting ball 20 will engage an undercut 38 in the recess 24 and the lock tab will be backed up by the opposite wall of the recess to positively look the socket on the extension. Before reaching this condition, however, ball 20 is pushed into the cross bore as the driver is pushed into the socket recess. This will cause ball 18 to raise the tab 40 and the tab will be engaged by the outer face 39 of the socket, thus pushing the tab to the right in FIG. 1.

The tab 40 is an integral part of the control means which includes an annular spring seat 42 captured inside sleeve 44 slideably mounted on the driver. The sleeve 44 has front and rear walls 46,48 turned in to capture the coil spring 50 inside the sleeve. The right hand coil 52 of the spring is captured in a groove 54 on the driver and the left coil of the spring bears via the ring 42 against the inside of the front wall 46 of the sleeve 44. Thus, the spring 52 biases the sleeve 44 to the left until the rear wall 48 of the sleeve engages the spring coil 52 which is engaged in the groove 54 in the end of the driver and functions as a limit stop. When the lock tab 40 is pushed to the right the tab and the spring seat 42 can move to the right relative to the sleeve if necessary. Therefore, if the user is holding the sleeve in a manner to restrict movement of the sleeve (a condition which could frustrate efforts to connect my prior designs) the lock tab 40 can still be raised and pushed to the right to enable the connection to be completed easily.

Since the tab 40 and the annular spring seat 42 are integral and do not tightly engage the driver the control means (tab and spring seat) can tilt or rock upwardly when ball 18 rises under the tab 40. When the tab rises it moves into up to engage the outside face 39 of the socket during the connection process. This means the applied force will act to push the tab 40 and seat 42 to the right in the drawings. Since the control means can move relative to sleeve 44 it makes no difference whether or not the sleeve is free to move. The spring acting on the seat 42 normally holds the seat 42 flat against the inside of the front wall 46 and this means the lock tab will be held down on the ball 18.

The sleeve 44 can be deep drawn by conventional means so long as the diameter is greater than the depth or length of the sleeve. This is a great cost saving over my prior designs which required machined parts. If the part is drawn, then it is assembled and the rear is coined or spun in to form the rear wall 48. If the diameter to length ratio is less than 1 then the sleeve can be made out of tubing, which is still a saving over the machined part of my prior designs.

Figure 6:
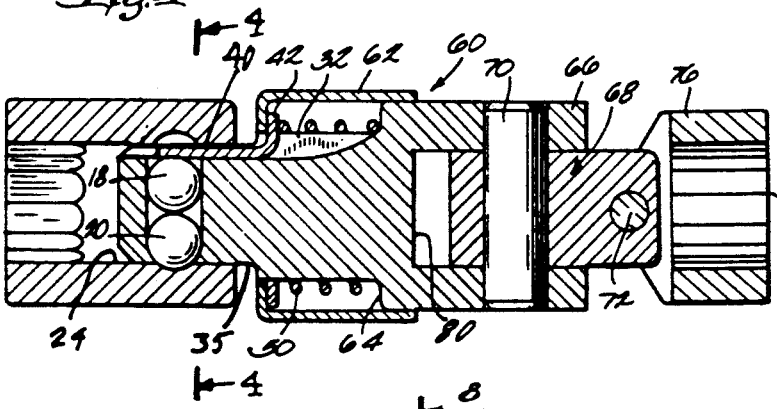
FIG. 6 is a vertical section through the novel quick release mechanism adapted to a driver incorporating a universal joint
Figure 7:
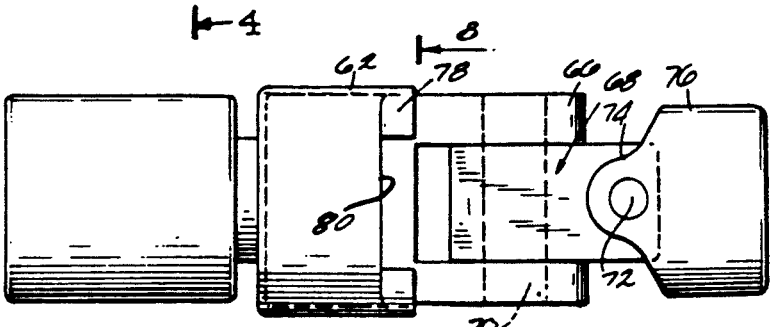
FIG. 7 is a top plan view of the driver shown in FIG. 6.
Figure 8:
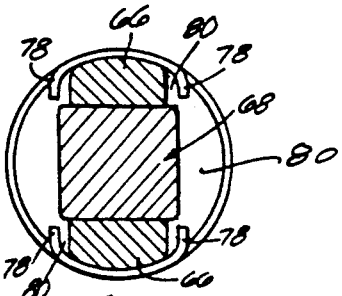
FIG. 8 is a sectional view taken as indicated by line 8—8 in FIG. 7.
Figure 9:
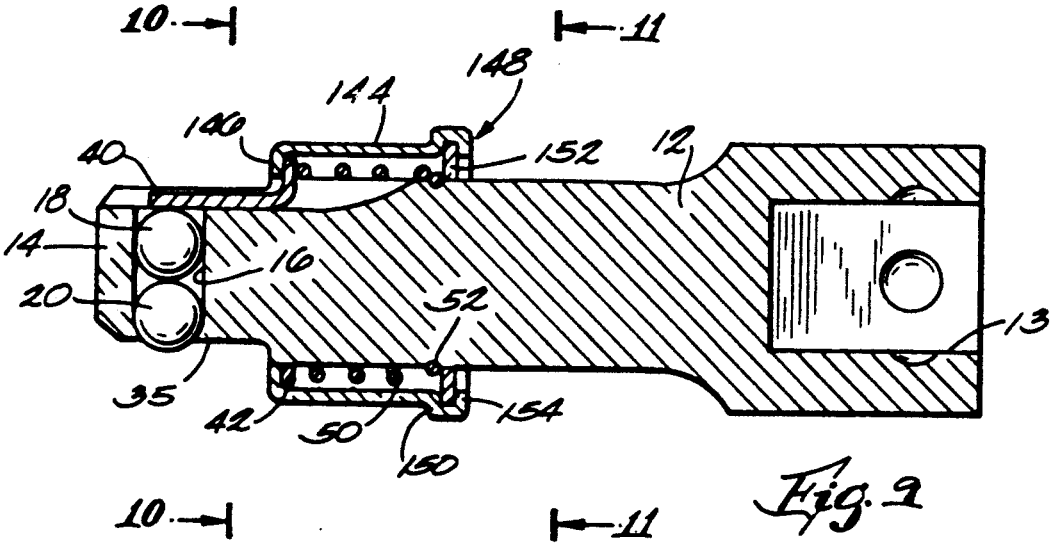
FIG. 9 is a vertical section through a modified and preferred construction.
Figure 10:
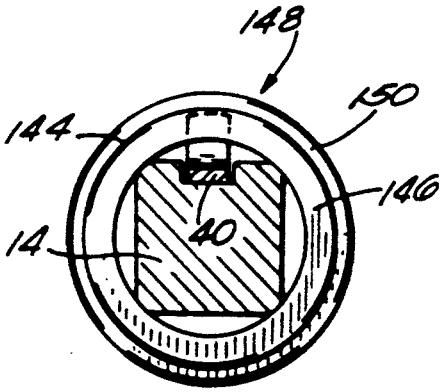
FIG. 10 is a section taken on line 10—10 in FIG. 9.
Figure 11:
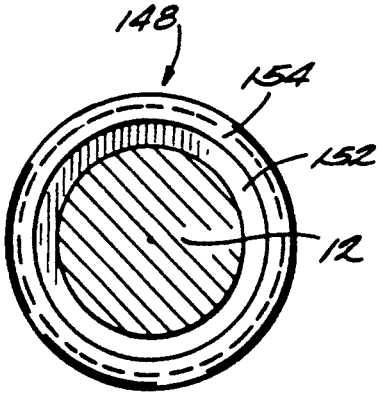
FIG. 11 is a section taken on line 11—11 in FIG. 9.
Figure 12:
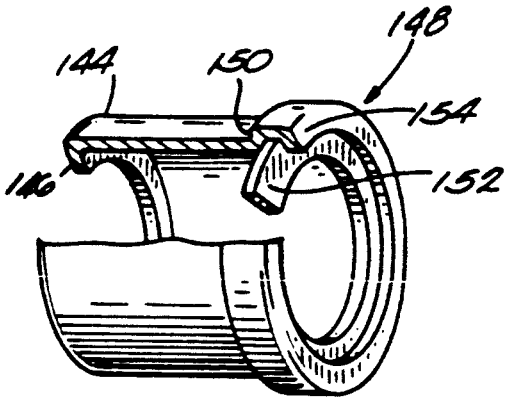
FIG. 12 is a perspective view of the sleeve assembly with part broken away.

Simply adding the structure of FIGS. 1-5 to a universal joint type driver would add too much length to the driver for it to be useful in tight spaces. This then requires another approach to provide a compact tool. The result is shown in FIGS. 6-8. In this arrangement the left hand portion of the driver 60 has a groove 32 receiving the lock tab 40 as with the first modification. But in this embodiment the sleeve 60 is more cylindrical and fits over the large diameter portion of the driver while the spring seats against the shoulder 64. The right portion of the driver 60 is shaped to provide two spaced ears 66, 66 projecting to the right from face 80 to receive the left end of the square connector 68. Pin 70 hinges the connector to the ears and driver while pin 72 hinges the connector to the ears 74 on the driven end member 76. Thus the pins 70, 72 at 90 degrees to each other define the universal joint. The sleeve 62 is retained on the driver by bending tabs 78 down alongside the ears 66 to limit motion of the sleeve to the left by engagement of the tabs with face 80 on each side of the ears 66. The face 80 functions as a limit stop. The sleeve is still free to move to the right to move the lock tab from the blocking/locking position shown in FIG. 6.

With this construction in conjunction with a universal joint the increase in length caused by incorporating the quick release feature is minimized. Bending the retaining tabs 78 down to engage the rear face 80 of the driver 60 to limit motion under influence of the spring 50 simplifies the construction.

Figure 2:
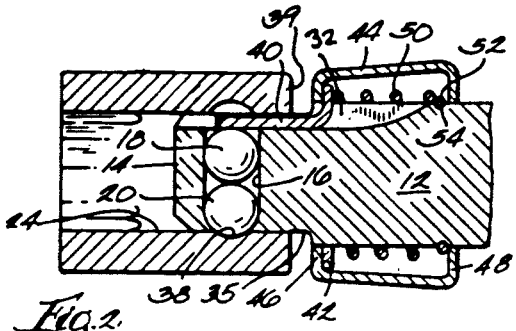
FIG. 2 is a vertical section of the driver engaged with a socket.
Figure 3:
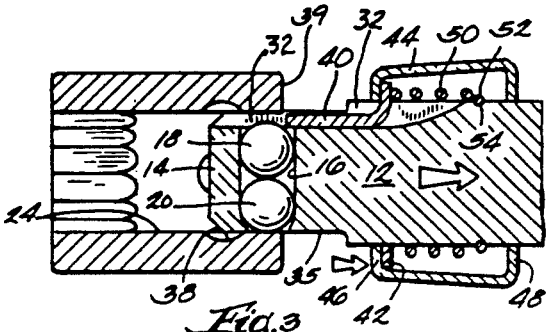
FIG. 3 is a vertical section showing the manner of disengaging the driver from the socket.
Figure 4:
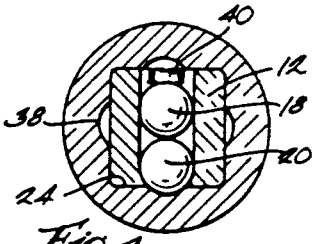
FIG. 4 is a vertical section through the end of the driver shown in FIG. 6.
Figure 5:
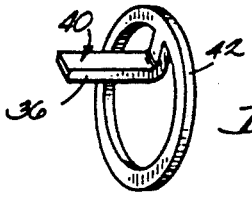
FIG. 5 is a perspective view of the key which has an annular portion which is captured inside the sleeve and against which the spring bears.

The tapered sleeve shown in FIG. 1 or an equivalent stepped sleeve configuration were used to get a large enough diameter to allow the large (right) end of the sleeve to be formed (rolled in) to capture the spring and engage the spring coil 52 which was captured in the groove on the shaft 12. The forming operation, however, proves to be difficult in practice and during assembly the large radial space between the sleeve and the shaft gave the spring enough room to invert itself and cease to function as a spring. Furthermore, the soft metal required to permit the deep drawing and forming of the sleeve did not provide a good wear surface of the internal diameter of the turned-in end of the sleeve on the shaft and the internal diameter was difficult to control. The construction shown in FIGS. 9-12 overcomes the problems.

The sleeve 144 in FIGS. 9-12 has a substantially uniform diameter which is more conventional in deep drawing and requires simpler, lower cost tooling. The left end 146 is turned in as with the other designs but the right end is formed to provide a shoulder 150 against which the washer 152 seats. The washer 152 is captured in that position when the right end of the sleeve is crimped over the washer as indicated at 154. The crimping is to capture the washer only and does not provide the internal diameter guiding the sleeve on the shaft 12; the washer provides that guiding function. The washer can be of hardened metal providing a superior and move accurate wear surface. The sleeve closely confines the spring and prevents the spring from inverting itself during assembly; the coils can't get past each other in the available space so the spring can't invert.

Various design variations are likely as this design is adapted to different types of drivers and extensions.

I claim:

1. A socket wrench driver provided with a push-on/quick release locking arrangement comprising, a drive end on said driver having an even number of flat drive surfaces and having a longitudinal axis, a cross bore through said drive end and intersecting opposed flat surfaces, said cross bore having an axis, lock means mounted in said bore and having a length generally equal to the distance between said opposed surfaces, an axial groove in one of said opposed flat surfaces, means retaining said lock means in said bore for movement relative to said bore between a release position in which said lock means is confined within said bore between said opposed flat surfaces and a lock position in which said lock means has limited projection beyond one of said opposed flat surfaces, an axially movable sleeve mounted on said driver for movement between a first position and a released position, said sleeve having an inturned front wall, control means mounted on said drive end and including a key lying in said groove and movable between a first position in which it overlies said lock means to urge said lock means to its said lock position and a release position in which it has moved away from the end of said driver to allow said lock means to move to its said release position in which it retracts into said cross bore, said control means also including an annular spring seat integral with said key and mounted inside said sleeve adjacent said front wall for movement with and with respect to said sleeve, a spring coiled around and mounted on said driver end inside said sleeve to act against said drive end and said spring seat to bias said spring seat against said front wall of said sleeve to urge said control means and said key towards said end, said control means and said key being slidably movable, along said longitudinal axis of said drive end, with and with respect to said sleeve, said control means having enough clearance relative to said drive end and relative to said sleeve to allow rocking movement of the control means whereby said key can be raised by said lock means when said lock means is moved from its said lock position to its said release position.

2. A socket wrench driver provided with a push-on/quick release locking arrangement comprising, a drive end on said driver having an even number of flat drive surfaces and having a longitudinal axis, a cross bore through the drive end intersecting opposed flat surfaces, said cross bore having an axis and an end at each of said opposed flat surfaces intersected by said bore, lock means mounted in said bore having a length generally equal to the distance between said opposed surfaces, a keyway in one of said opposed flat surfaces, means retaining said lock means relative to said bore while allowing limited projection of a portion of the lock means to a lock position beyond said other surface, an axially movable sleeve mounted on said driver for movement between a locked position and a released position, said sleeve having an inwardly turned front wall, an annular spring seat positioned inside said sleeve adjacent said front wall of said sleeve for slidable movement, along said longitudinal axis of said drive end, with and with respect to said sleeve and including a lock key in said keyway operative to obstruct movement of said lock means into said groove when the sleeve is in said locked position whereby the lock means projects from said other of said opposed flat surfaces, said key being free to retract from said locked position when said sleeve is moved to its said released position whereby said key no longer obstructs said lock means and the lock means can move into said bore when an external force acts on the projecting portion of said lock means, and a spring mounted inside said sleeve and bearing against said spring seat to bias said key and sleeve to their said locked positions.

3. A driver according to claim 2 in which said spring is compressed between said spring seat and said driver.

4. A driver according to claim 3 including means limiting movement of said sleeve under influence of said compressed spring.

5. A driver according to claim 4 in which said means limiting movement of said sleeve comprises a limit stop engaged by said sleeve.

6. A driver according to claim 5 in which said limit stop comprises a coil of said spring engaged in a groove in said driver, and said sleeve is provided with means engageable with said coil.

7. A driver according to claim 3 in which said driver has an end opposite said drive end, said opposite end having a face from which spaced ears project, said sleeve sliding on the outside of said drive end and having tabs bent inwardly to engage said face when the sleeve has been moved to its locked position.

8. A socket wrench driver provided with a push-on/quick release locking arrangement comprising, a drive end on said driver having an even number of flat drive surfaces and having an axis, a cross bore through said drive end and intersecting opposed flat surfaces, said cross bore having an axis, lock means mounted in said bore and having a length generally equal to the distance between said opposed surfaces, an axial groove in one of said opposed flat surfaces, means retaining said lock means in said bore for movement relative to said bore between a release position in which said lock means is confined within said bore between said opposed flat surfaces and a lock position in which said lock means has limited projection beyond one of said opposed flat surfaces, an axially movable cylindrical sleeve mounted on said driver for movement between a first position and a released position, said sleeve having an inturned front wall and a rear shoulder, a washer seated on said shoulder, the rear of said sleeve being crimped onto said washer to hold it on said shoulder, control means mounted on said driver end and including a key lying in said groove and movable between a first position in which it overlies said lock means to urge said lock means to its said lock position and a release position in which it has moved away from the end of said driver to allow said lock means to move to its said release position in which it retracts into said cross bore, said control means also including an annular spring seat integral with said key and mounted inside said sleeve adjacent said front wall for movement with and with respect to said sleeve, a spring coiled around and mounted on said driver end inside said sleeve to act against said drive end and said spring seat to bias said spring seat against said front wall of said sleeve to urge said control means and said key towards said end, said sleeve being sized to confine said spring radially to prevent said spring from inverting, said control means and said key being movable with and with respect to said sleeve, said control means having enough clearance relative to said drive end and relative to said sleeve to allow rocking movement of the control means whereby said key can be raised by said lock means when said lock means is moved from its said lock position to its said release position.

9. A socket wrench driver having a cylindrical shaft provided with a push-on/quick release locking arrangement comprising, a drive end on said driver having an even number of flat drive surfaces and having an axis, a cross bore through the drive end intersecting opposed flat surfaces, said cross bore having an axis and an end at each of said opposed flat surfaces intersected by said bore, lock means mounted in said bore having a length generally equal to the distance between said opposed surfaces, a keyway in one of said opposed flat surfaces, means retaining said lock means relative to said bore while allowing limited projection of the lock means to a lock position beyond said other surface, an axially movable substantially cylindrical sleeve mounted on said driver for movement between a locked position and a released position, said sleeve having an inwardly turned front wall and an outwardly facing shoulder at its rear, a washer seated on said shoulder and having an internal diameter sliding on said cylindrical shaft, said sleeve being crimped over said washer to hold it against said shoulder, an annular spring seat positioned inside said sleeve adjacent said front wall of said sleeve for movement with and with respect to said sleeve and including a lock key in said keyway operative to obstruct movement of said lock means into said groove when the sleeve is in said locked position whereby the lock means projects from said other of said opposed flat surfaces, said key being free to retract from said locked position when said sleeve is moved to its said released position whereby said key no longer obstructs said lock means and the lock means can move into said bore when an external force acts on the projecting portion of said lock means, and a spring mounted inside said sleeve and bearing against said spring seat to bias said key and sleeve to their said locked positions, the clearance between said spring and said sleeve being small enough to prevent said spring from inverting during assembly or use.

* * * * *